US009782972B2

(12) United States Patent
Nishida

(10) Patent No.: US 9,782,972 B2
(45) Date of Patent: Oct. 10, 2017

(54) PRINT DEVICE

(71) Applicant: BROTHER KOGYO KABUSHIKI KAISHA, Nagoya-shi Aichi-ken (JP)

(72) Inventor: Katsunori Nishida, Aichi-gun (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/969,548

(22) Filed: Dec. 15, 2015

(65) Prior Publication Data

US 2016/0167387 A1 Jun. 16, 2016

(30) Foreign Application Priority Data

Dec. 15, 2014 (JP) ..... 2014-252975

(51) Int. Cl.
*B41J 2/165* (2006.01)

(52) U.S. Cl.
CPC ..... *B41J 2/16538* (2013.01); *B41J 2/16508* (2013.01); *B41J 2002/16502* (2013.01)

(58) Field of Classification Search
CPC ..... B41J 2/16535; B41J 2/16538
See application file for complete search history.

(56) References Cited

U.S. PATENT DOCUMENTS

2006/0139397 A1* 6/2006 Hashi ..... B41J 2/16532 347/30
2008/0079770 A1* 4/2008 Sloan ..... B41J 11/005 347/29
2008/0178443 A1* 7/2008 Tokukura ..... B41J 2/161 29/25.35
2011/0273512 A1* 11/2011 Murase ..... B41J 2/14209 347/38
2012/0162302 A1* 6/2012 Oguchi ..... B41J 2/175 347/16
2013/0215191 A1* 8/2013 Hutchison ..... B41J 2/16547 347/33

FOREIGN PATENT DOCUMENTS

JP 2005014345 A 1/2005

* cited by examiner

*Primary Examiner* — Jason Uhlenhake
(74) *Attorney, Agent, or Firm* — Fox Rothschild LLP

(57) ABSTRACT

A discharge portion includes a discharge face on a first direction side. A support portion supports the discharge portion on a second direction side. A wiper can move from a third direction side to a fourth direction side of the discharge face. The third direction and the fourth direction orthogonally intersect the first direction and the second direction. A first cover portion covers an edge on the third direction side of the support portion and includes a first flat face part which is provided parallel to the discharge face and located to the first direction side of the discharge face. A second cover portion covers an edge on the fourth direction side of the support portion. The second cover portion includes a second flat face part. The second flat face part is provided parallel to the discharge face and to the second direction side of the discharge face.

10 Claims, 11 Drawing Sheets

PRINT DEVICE

CROSS-REFERENCE TO RELATED APPLICATION

This application claims priority to Japanese Patent Application No. 2014-252975 filed on Dec. 15, 2014, the disclosure of which is herein incorporated by reference in its entirety.

BACKGROUND

The present disclosure relates to a print device configured to perform printing by discharging a liquid onto a print medium.

Among inkjet printers configured to perform printing by discharging ink from nozzles of an inkjet head onto a print medium, an inkjet printer is known that is provided with a wiper blade. The wiper blade wipes off ink that remains on the surface of a nozzle plate. Among the known types of inkjet printers, an inkjet printer is known that is provided with a nozzle cover. The nozzle cover is a cover component configured to cover the outer margins of the surface of the nozzle plate. The cover component prevents damage to the nozzle plate and the like that is caused by the wiping of the surface of the nozzle plate by the wiper blade.

SUMMARY

In the inkjet head described above, nozzle covers are provided on both the upstream side and the downstream side in relation to the direction in which the wiper blade advances. The thickness of the nozzle cover creates a level difference in a direction protruding toward the wiper blade between the surface of the nozzle cover and a discharge face, which is the surface of the nozzle plate. Ink that has been wiped off by the wiper blade thus tends to accumulate at the level difference, particularly on the downstream side in relation to the direction in which the wiper blade advances. As the accumulated ink spreads toward the nozzles, the discharge of the ink from the nozzles becomes worse, creating the possibility that the printing quality of the inkjet printer will deteriorate.

Various embodiments of the general principles described herein provide a print device that decreases the deterioration of the printing quality by inhibiting the accumulation of liquid on the discharge face.

Embodiments herein provide a print device including a discharge portion, a support portion, a wiper, a first cover portion, and a second cover portion. The discharge portion includes a discharge face on a first direction side. A plurality of discharge outlets that discharge a liquid are formed in the discharge face. The support portion is provided to support the discharge portion on a second direction side. The second direction is the opposite direction from the first direction. The wiper is provided to be able to move from a third direction side to a fourth direction side of the discharge face while in contact with the discharge face from the first direction side. The third direction and the fourth direction orthogonally intersect the first direction and the second direction. The fourth direction is the opposite direction from the third direction. The first cover portion is provided to cover an edge on the third direction side of the support portion. The first cover portion includes a first flat face part. The first flat face part is provided parallel to the discharge face and located to the first direction side of the discharge face. The second cover portion is provided to cover an edge on the fourth direction side of the support portion. The second cover portion includes a second flat face part. The second flat face part is provided parallel to the discharge face and to the second direction side of the discharge face.

BRIEF DESCRIPTION OF THE DRAWINGS

Embodiments will be described below in detail with reference to the accompanying drawings in which.

DETAILED DESCRIPTION

An overall configuration of a printer 1 will be explained with reference to FIGS. 1 and 2. The top side, the bottom side, the lower left side, the upper right side, the lower right side, and the upper left side in FIG. 1 respectively correspond to the top side, the bottom side, the front side, the rear side, the right side, and the left side of the printer 1.

Figure 1:
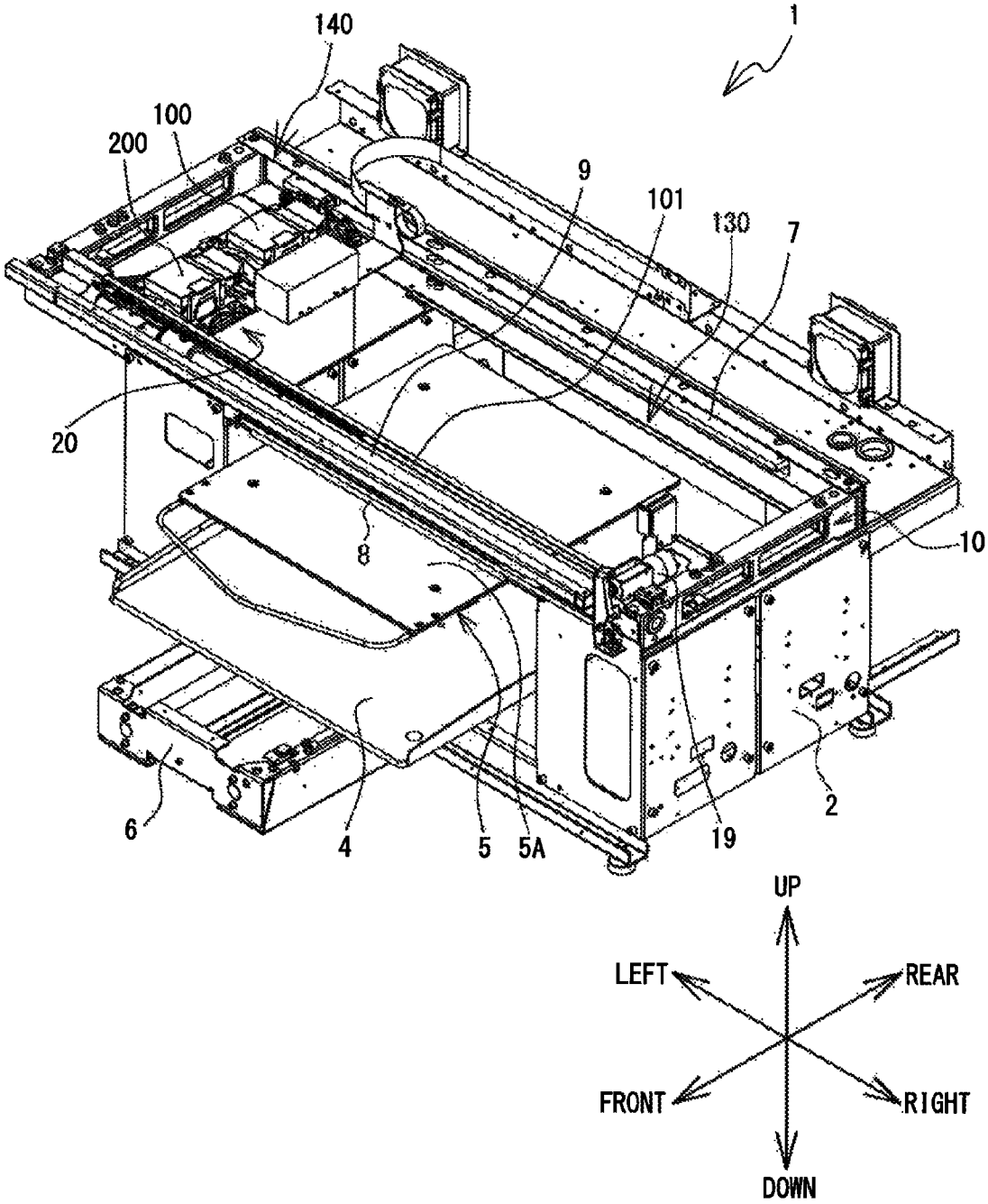
FIG. 1 is an oblique view of a printer.

As shown in FIG. 1, the printer 1 is an inkjet printer that, by discharging a liquid ink, performs printing on a print medium (not shown in the drawings). The print medium for the printer 1 is a cloth, such as a T-shirt or the like. The printer 1 may also use paper or the like as the print medium. The printer 1 is able to print a color image on the print medium by discharging five different types of the ink (white (W), black (K), yellow (Y), cyan (C), and magenta (M)) downward. In the explanation that follows, of the five types of the ink, the white-colored ink will be called the white ink, and the four colored inks, black, cyan, yellow, and magenta, will be collectively called the color inks. In a case where the white ink and the color inks are referenced collectively, as well as in a case where no one ink is specified, simply a term "the ink" will be used. In a case where a cloth is used as the print medium, a technique that has been used for some time is to incorporate a synthetic resin into the ink in order to improve the ink's adhesion to the cloth.

The printer 1 is mainly provided with a housing 2, a platen drive mechanism 6, a platen 5, a tray 4, a frame body 10, a guide shaft 9, a rail 7, a clearance sensor 8, a carriage 20, head units 100, 200, a drive belt 101, a drive motor 19, and, in a non-printing area 140 that will be described later, maintenance portions 141, 142 (refer to FIG. 2).

The housing 2 is substantially a three-dimensional rectangle whose long axis extends from left to right. An operation portion (not shown in the drawings) that performs operations of the printer 1 is provided in a position on the right front side of the housing 2. The operation portion is provided with a display and an operation button. The display displays various types of information. The operation button is operated when a user inputs commands that are related to various types of operations of the printer 1.

The platen drive mechanism 6 is provided with a pair of guide rails (not shown in the drawings), the platen 5, and the tray 4. The pair of the guide rails extend from the front to the rear on the inner side of the platen drive mechanism 6 and support the platen 5 and the tray 4 such that the platen 5 and the tray 4 can move toward the front and the rear. The platen drive mechanism 6, using as a drive source a motor (not shown in the drawings) that is provided at a rear edge of the platen drive mechanism 6, moves the platen 5 toward the front and the rear along the pair of the guide rails in the interior of the housing 2. The platen 5 is a substantially rectangular plate in a plan view and has a long axis extending in the front-rear direction of the housing 2. The platen 5 is provided below the frame body 10, which will be described later. The platen 5 holds the print medium, which is a cloth, such as a T-shirt or the like, for example, on a holding face 5A on the top of the platen 5.

The tray 4 is substantially rectangular in a plan view and is provided below the platen 5. When the user places a T-shirt or the like on the platen 5, the tray 4 receives the sleeves and the like of the T-shirt. The sleeves and the like are thus protected, such that they do not come into contact with other parts in the interior of the housing 2.

The frame body 10 is substantially rectangular in a plan view and installed in the top portion of the housing 2. The front side of the frame body 10 supports the guide shaft 9, and the rear side of the frame body 10 supports the rail 7. The guide shaft 9 is a shaft member that is provided with a shaft portion extending from left to right on the inner side of the frame body 10. The rail 7 is a rod-shaped member that is located opposite the guide shaft 9 and extends from left to right. The clearance sensor 8 is provided on the front side of the frame body 10 and extends across the frame body 10 from left to right. When the printer 1 is performing printing and the platen 5 moves in the front-rear direction through the interior of the housing 2, the clearance sensor 8 detects impediments placed on the platen 5, such as trash or the like, as well as wrinkles in the cloth or the like.

The carriage 20 is supported such that it can be conveyed to the left and the right along the guide shaft 9. The head units 100, 200 are carried on the carriage 20 and are arrayed in the front-rear direction. The head unit 100 is located to the rear of the head unit 200. A head portion 110 that is able to discharge the ink toward the print medium is provided on the bottom of the head unit 100 (refer to FIG. 4). The bottom of the head unit 200 is configured in the same manner as that of the head unit 100.

The drive belt 101 is a belt-shaped member and spans the inner side of the frame body 10 in the left-right direction. The drive belt 101 is made of a flexible synthetic resin. The drive motor 19 is provided in the front right portion of the inner side of the frame body 10. The drive motor 19 is capable of rotating forward and in reverse, and is coupled to the carriage 20 through the drive belt 101. Printing on the print medium that is supported by the platen 5 is performed as hereinafter described. When the drive motor 19 drives the drive belt 101, the carriage 20 is moved reciprocally to the left and the right. The head units 100, 200 are thus moved reciprocally to the left and the right. As the head units 100, 200 move, they discharge the inks from the bottom sides of the head units 100, 200 toward the platen 5, which is located such that it faces the head units 100, 200.

Figure 2:
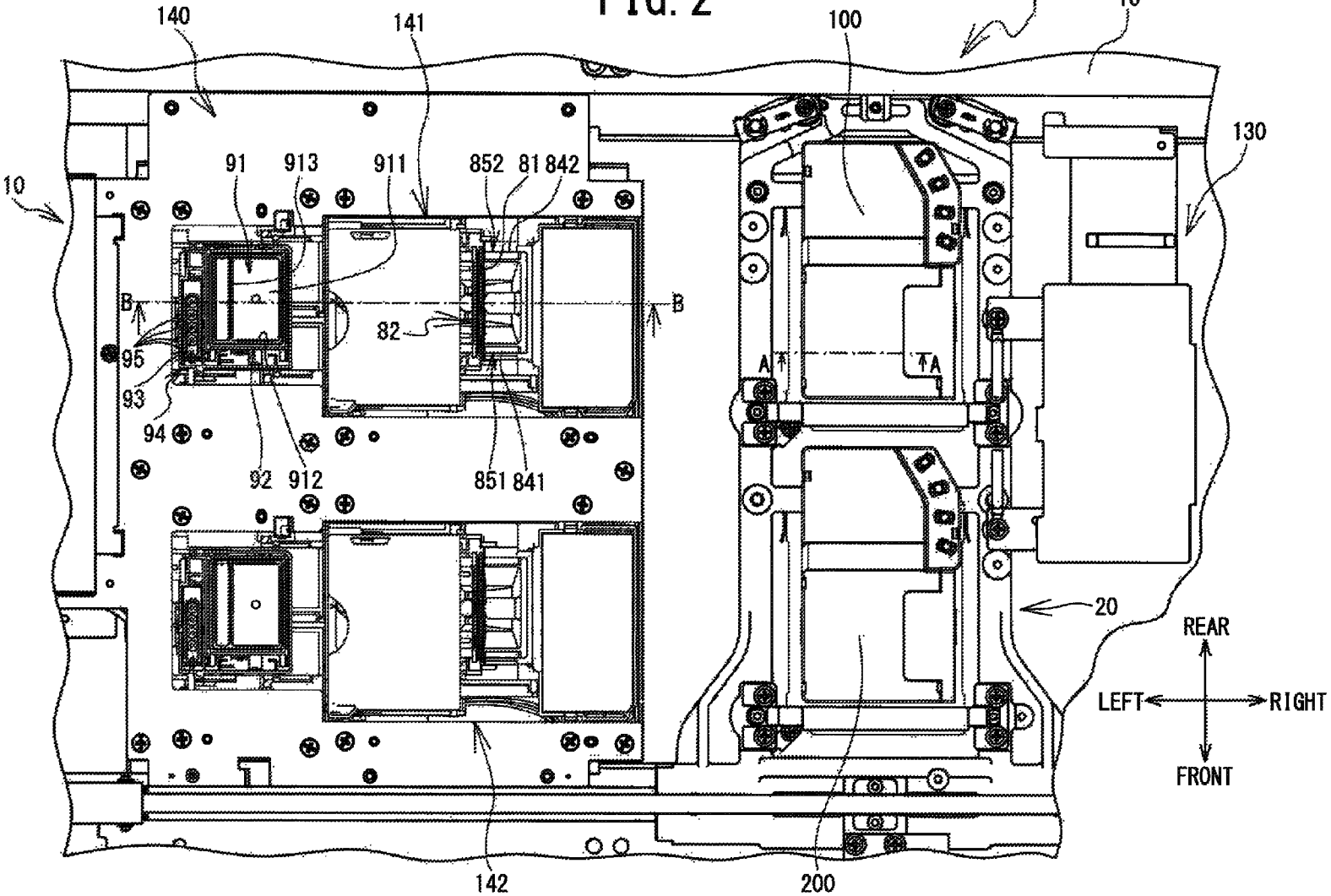
FIG. 2 is a plan view of the printer.

As shown in FIGS. 1 and 2, the carriage 20 is provided on the inner side of the frame body 10. Therefore, the head units 100, 200 move to the left and the right between the left end and the right end of the inner side of the frame body 10. Along the path that the head units 100, 200 travel, the area where the printing is performed by the head units 100, 200 will be called the printing area 130. Along the path that the head units 100, 200 travel, the area that is not in the printing area 130 will be called the non-printing area 140. The non-printing area 140 is an area in the left end portion of the printer 1. The printing area 130 is the area from the right edge of the non-printing area 140 to the right end of the printer 1. The platen 5 and the tray 4 are provided in the printing area 130.

As shown in FIG. 2, the maintenance portions 141, 142 are provided in the non-printing area 140, below the travel paths of the head units 100, 200, respectively. Various types of maintenance operations such as purging, nozzle face wiping, and the like, are performed in the maintenance portions 141, 142 in order to restore the ink discharge performance of the head units 100, 200 and ensure the printing quality of the printer 1. Purging is an operation by which the head units 100, 200 expel, from the heads 110 and the like, ink that contains foreign matter, gas bubbles, and the like (refer to FIG. 10). By performing purging, for example, ink containing foreign matter, gas bubbles, and the like will be drawn from the heads 110 and thus the printer 1 is able to decrease the possibility of causing problems with the discharge of the ink from the heads 110. Nozzle face wiping is an operation in which excess ink that remains on the surfaces of nozzle faces 112 of the heads 110 (refer to FIG. 3) is wiped off by a below-described wiper 81 (refer to FIG. 11). By performing the nozzle face wiping operation, the printer 1 is able, for example, to decrease the possibility that residual and excessive ink on the nozzle faces 112 will harden and bind to the nozzle faces 112 then the ink will be difficult to be discharged from the nozzle faces 112. The maintenance portions 141, 142 will be described in detail later.

The configuration of the head units 100, 200 will be explained in detail with reference to FIGS. 3 to 9. The head unit 100 discharges the white ink. The head unit 200 discharges the color inks. The white ink is discharged before the color inks are discharged and, in a case where the color of the print medium is dark, for example, is discharged as a base coat over all or a portion of the area where printing will be performed. After the white ink has been discharged over all or a portion of the area where printing will be performed, the color inks are used for creating a pattern or the like in that area. The white ink may also be used as an ink that creates a pattern or the like. The printer 1 is thus able to perform various types of printing, regardless of the color of the print medium. The configuration of the head unit 200 is the same as that of the head unit 100, except for the fact that the head unit 200 discharges the color inks instead of the white ink, so explanations of the head unit 200 will be omitted, as appropriate.

Figure 3:
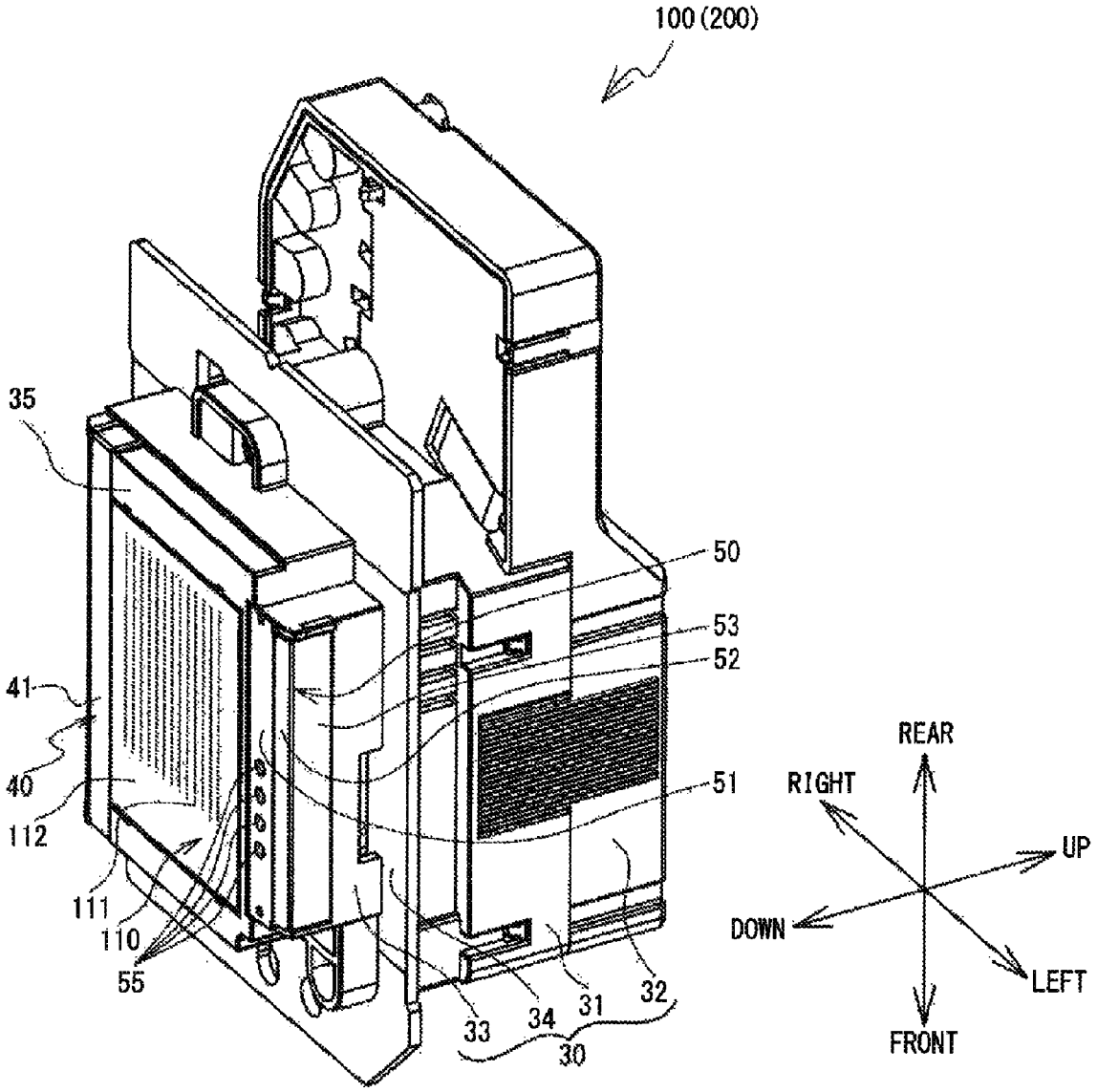
FIG. 3 is an oblique view of a head unit.

As shown in FIGS. 3 to 6, the head unit 100 is provided with a housing 30, the head portion 110, a buffer tank 60, an exhaust flow channel portion 65, an exhaust portion 70, a nozzle guard 40, and an exhaust guard 50. As shown in FIG. 3, the housing 30 is a substantially box-shaped support body. The bottom portion of the housing 30 supports the head portion 110. The housing 30 is provided with a support base 34, a middle housing 31, an upper housing 32, and a lower housing 33. The support base 34 is a frame-like plate member having a rectangular shape in a plan view and is made of metal. A through-hole (not shown in the drawings) is formed in a central portion of the support base 34. The middle housing 31 is made of a synthetic resin and has a square tube shape that extends upward from the support base 34. The middle housing 31 is affixed to the top face of the support base 34 in a position where the tube hole of the middle housing 31 communicates with the through-hole in the support base 34. The upper housing 32 is made of a synthetic resin and is substantially box-shaped, with its bottom side open. The upper housing 32 is provided such that it covers the tube hole of the middle housing 31 and the buffer tank 60 (refer to FIGS. 4 and 5) from the top side, which is the opposite side from the head portion 110. The lower housing 33 is provided with a bottom face 35 that has an opening, and it is substantially box-shaped, with its top side open. The lower housing 33 is affixed to the bottom face of the support base 34 in a state in which the head portion 110 is exposed toward the bottom, through the opening in the bottom face 35. The lower housing 33 may be made of a synthetic resin that is reinforced with glass fiber. Making each of the parts of the housing 30 from a synthetic resin with superior workability improves the productivity of the head unit 100.

Figure 6:
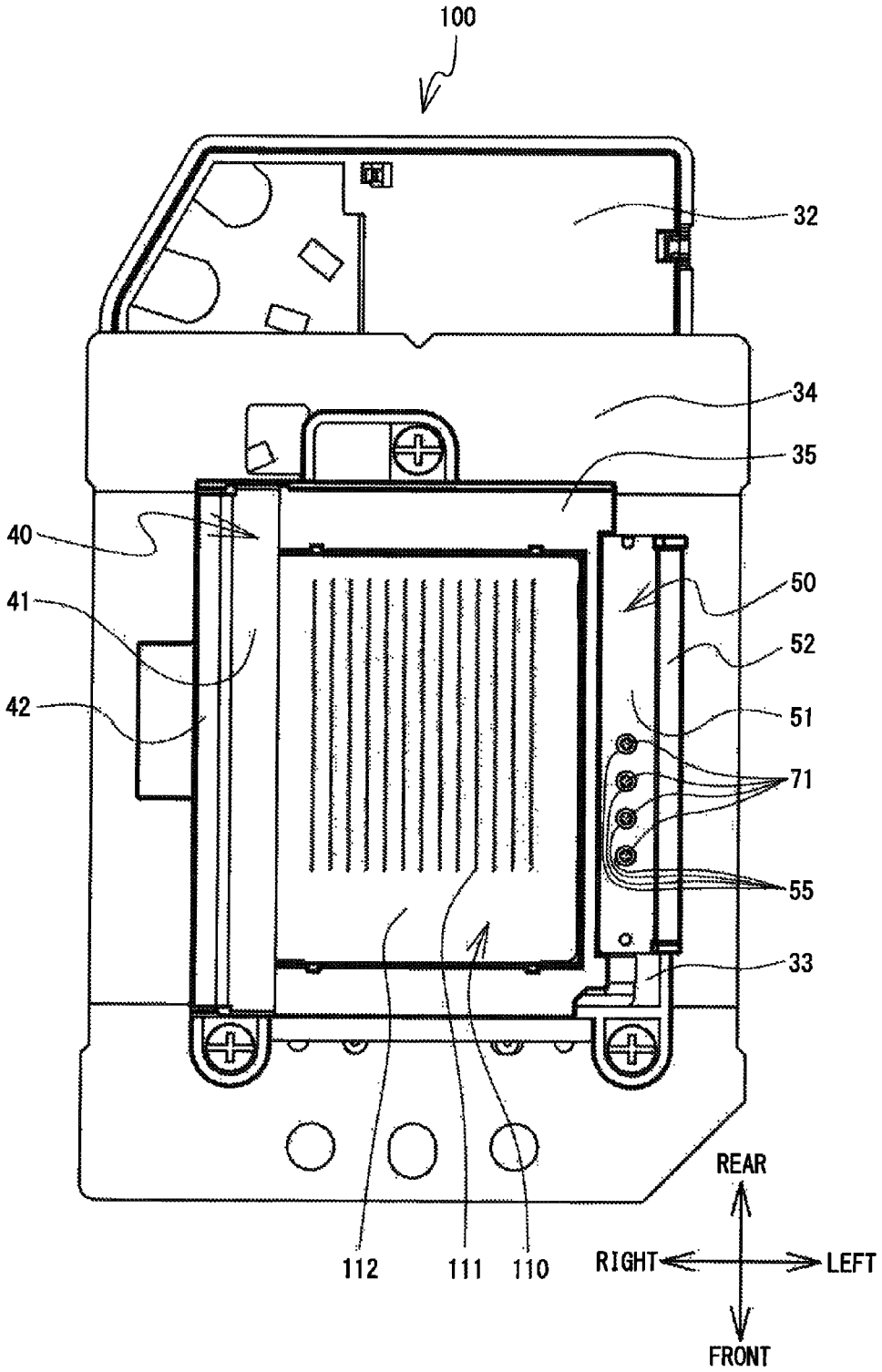
FIG. 6 is a bottom view of the head unit.

As shown in FIG. 6, the head portion 110 is rectangular in a bottom view and is provided to cover the opening in the bottom face 35. The head portion 110 is formed by laminating stainless steel (SUS) plates in which minute holes are formed in positions that correspond to a plurality of nozzles 111. The head portion 110 is provided with the nozzle face 112. The nozzle face 112 is a face having the plurality of the nozzles 111, which are able to discharge the inks downward. The head portion 110 is supported from above by the lower housing 33, in a state in which the nozzle face 112 faces downward. A row of the nozzles 111 is formed on the nozzle face 112 in the front-rear direction. A plurality of the rows of the nozzles 111 are arrayed in the left-right direction. The nozzle face 112 is a flat surface parallel to the horizontal plane and forms the bottom face of the head unit 100. The interior of the head portion 110 is divided into four sections from left to right. Therefore, each one of the four different color inks in the head unit 200 can be discharged selectively. The plurality of the nozzles 111 correspond to a plurality of discharge channels (not shown in the drawings) that are provided in the interior of the head portion 110. The operations of a plurality of piezoelectric elements (not shown in the drawings) that are provided in the interior of the head portion 110 make it possible for the plurality of the discharge channels to discharge the color inks downward from the plurality of the nozzles 111.

Figure 4:
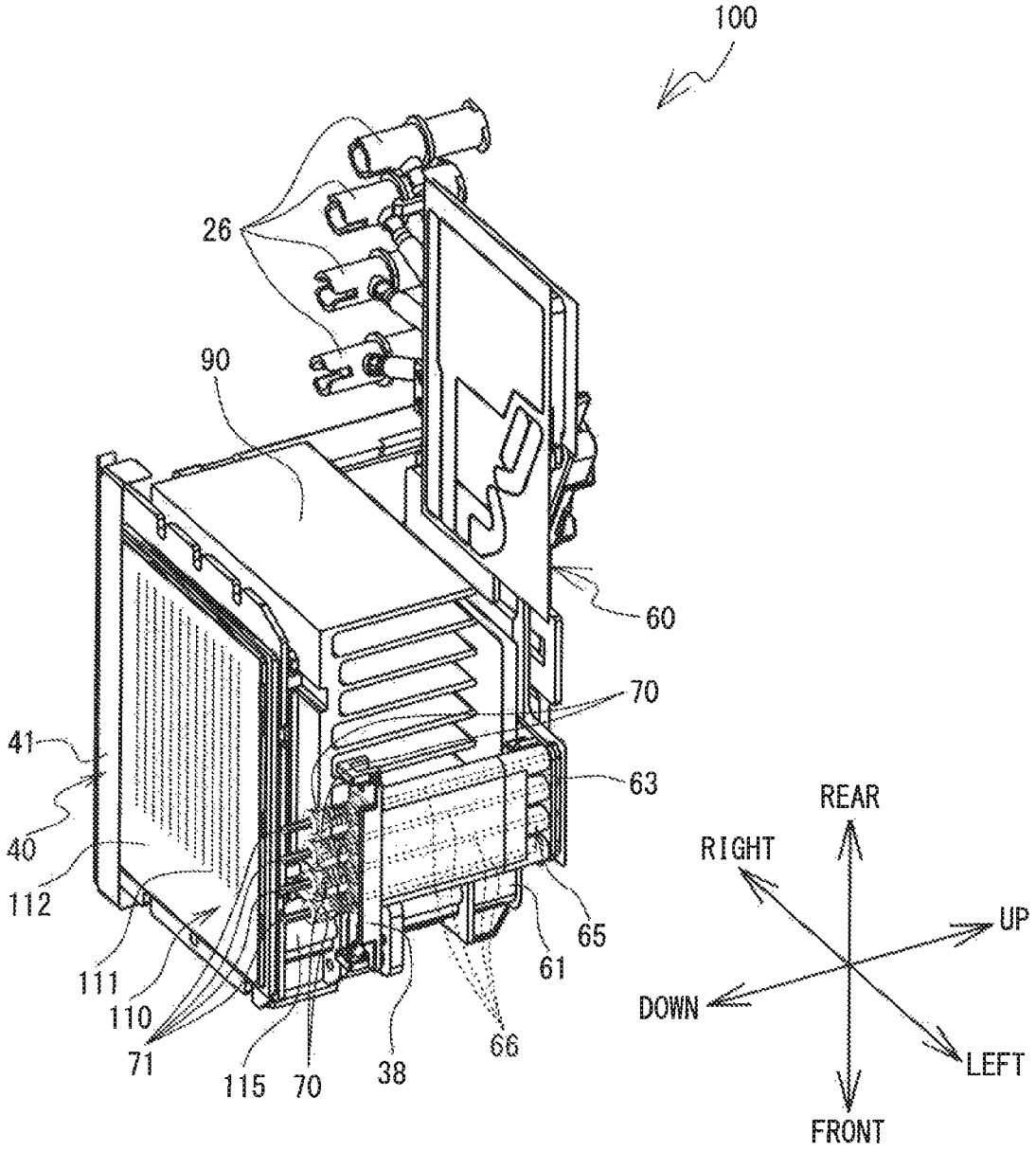
FIG. 4 is an oblique view of the interior of the head unit.
Figure 5:
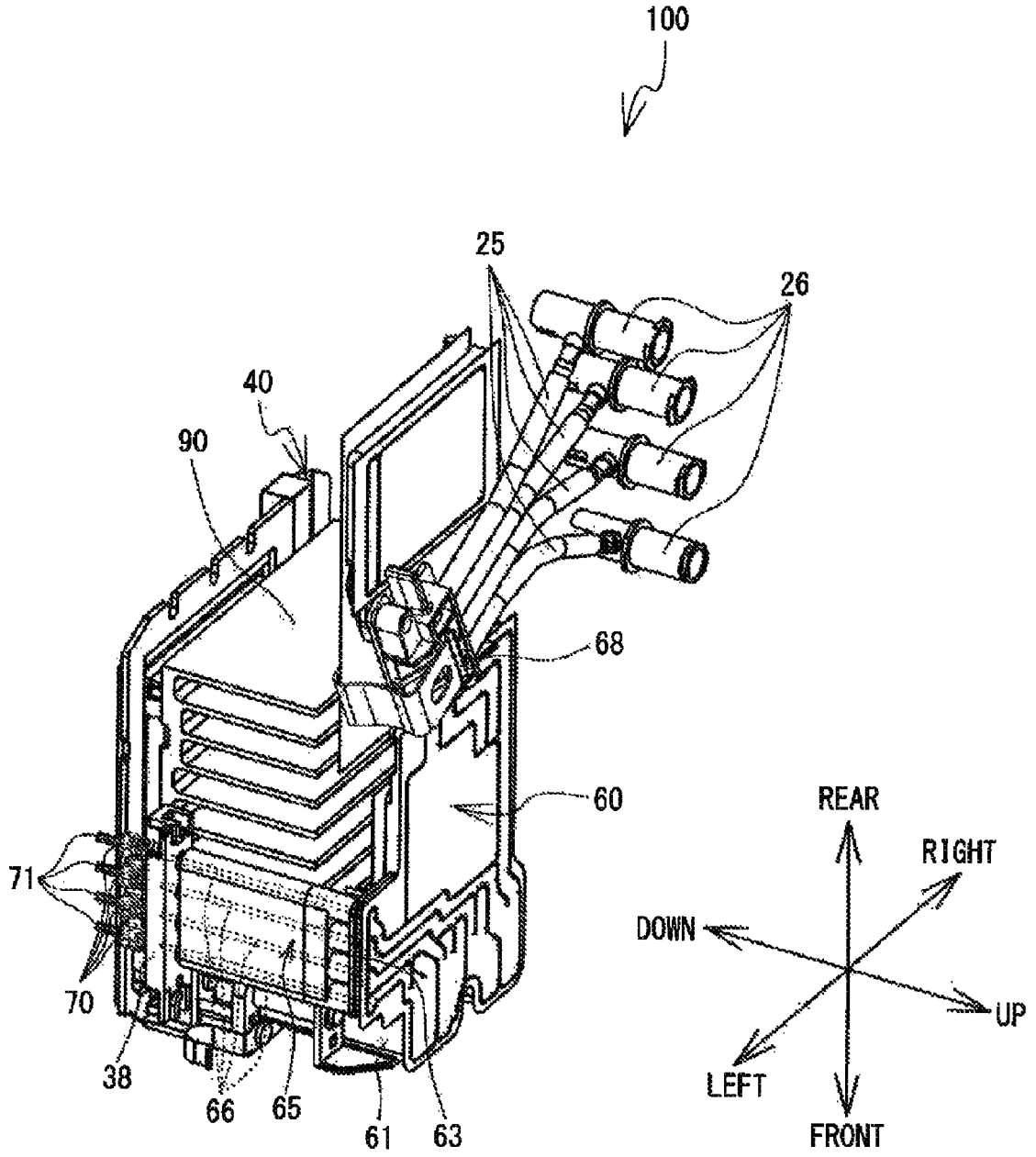
FIG. 5 is an oblique view of the interior of the head unit.

As shown in FIGS. 4 and 5, the buffer tank 60 is formed into a hollow three-dimensional rectangular shape. The buffer tank 60 extends parallel to the nozzle face 112 in the upper portion of the head unit 100. A tube joint 68 is provided on the top face of the buffer tank 60. The one ends of four flexible tubes 25 are each connected to the tube joint 68. In the head unit 100, the four tubes 25 that are connected to the tube joint 68 all supply the white ink to the buffer tank 60. In the head unit 200, each one of the four tubes 25 that are connected to the tube joint 68 supplies one of the four different color inks (K, Y, C, M) to the buffer tank 60. Connection units 26 are provided on the other ends of the four tubes 25 which are ends opposite to the one ends. The connection units 26 connect the four tubes 25 to ink flow channels from a main tank (not shown in the drawings) that stores the inks on the right side of the housing 2. The buffer tank 60 is able to store each one of the color inks (K, Y, C, M) in one of four storage chambers 61 (refer to FIG. 7), in order to supply to the head portion 110 the inks that have been supplied from the four tubes 25.

The buffer tank 60 temporarily stores, in its interior, the ink that has been supplied from the main tank through the tubes 25 and the connection units 26. Therefore, the buffer tank 60 can absorb pressure fluctuations in the ink that is to be supplied to the head portion 110. The buffer tank 60 is provided with first outflow portions 62 (refer to FIG. 7) and second outflow portions 63. The first outflow portions 62 are provided on the bottom sides of the four storage chambers 61 and on the front edge of the buffer tank 60. The first outflow portions 62 are connected to four supply flow channels 115 that will be described later (refer to FIG. 7) and supply the ink to the head portion 110. The second outflow portions 63 are provided on the left edge of the buffer tank 60 and are connected to the exhaust flow channel portion 65, without passing through the head portion 110. In the positions of the second outflow portions 63, the buffer tank 60 is able to accumulate bubbles of air and the like that are generated at the side of the main tank in the process of supplying the ink and are staying in the interior of the buffer tank 60.

As shown in FIGS. 4 and 5, the exhaust flow channel portion 65 has a substantially three-dimensional rectangular shape that extends downward from the second outflow portions 63, and it is formed from an elastic material such as synthetic rubber or the like, for example. The exhaust flow channel portion 65 is provided with four hollow exhaust flow channels 66 that extend through the interior of the exhaust flow channel portion 65 in the up-down direction. The upper ends of the four exhaust flow channels 66 are continuous with the second outflow portions 63. The lower ends of the four exhaust flow channels 66 are each connected to the upper end of one of the four exhaust portions 70. The four exhaust portions 70 are provided on a base 38 of the lower housing 33 such that they are arrayed in the front-rear direction at the same intervals as the four exhaust flow channels 66. The exhaust portions 70 are made of metal, shaped like nozzles, and provided with flow channels in their interiors that extend in the up-down direction. Open-close valves (not shown in the drawings) are provided in the interiors of the flow channels. Exhaust outlets 71 that serve as outlets for the flow channels in the interiors of the exhaust portions 70 are provided on the lower ends of the exhaust portions 70. The four exhaust outlets 71 are provided such that they are open at the bottom face 35, and they are arrayed in the front-rear direction to the left of the head portion 110. In addition, the head unit 100 includes other members such as metal fins 90 provided to radiate heat generated in the head portion 110 during printing and the like.

As shown in FIG. 6, the nozzle guard 40 is a metal part that covers the entire right edge of the bottom face 35 and the entire right edge of the head portion 110 in the front-rear direction. The nozzle guard 40 is formed as a separate piece from the lower housing 33. The nozzle guard 40 includes a flat face part 41 that is parallel to the nozzle face 112 and is located lower than the nozzle face 112. The nozzle guard 40 is provided in a state in which the flat face part 41 covers the right edge of the bottom face 35 and the right edge of the head portion 110 from below the nozzle face 112. The exhaust guard 50 is a metal part that covers the entire left edge of the bottom face 35 in the front-rear direction. In the same manner as the nozzle guard 40, the exhaust guard 50 is formed as a separate piece from the lower housing 33. The exhaust guard 50 includes a flat face part 51 that is parallel to the nozzle face 112 and is located higher than the nozzle face 112. The exhaust guard 50 is provided in a state in which the flat face part 51 covers the left edge of the bottom face 35 from below. The right edge of the flat face part 51 is located to the left of the left edge of the head portion 110 and does not cover the left edge of the head portion 110. Four openings 55, which are holes that extend through the flat face part 51 in the up-down direction, are provided in the front portion of the flat face part 51. The four openings 55 are formed to be slightly larger than the four exhaust outlets 71 and arrayed in the front-rear direction at the same intervals as the four exhaust outlets 71. Therefore, the four exhaust outlets 71 are downwardly exposed through the four openings 55. Both the nozzle guard 40 and the exhaust guard 50 may be made of stainless steel (SUS) with a thickness of approximately 0.1 millimeters, for example. Forming the nozzle guard 40 and the exhaust guard 50 as separate pieces from the lower housing 33 can improve the productivity of the head unit 100.

Figure 7:
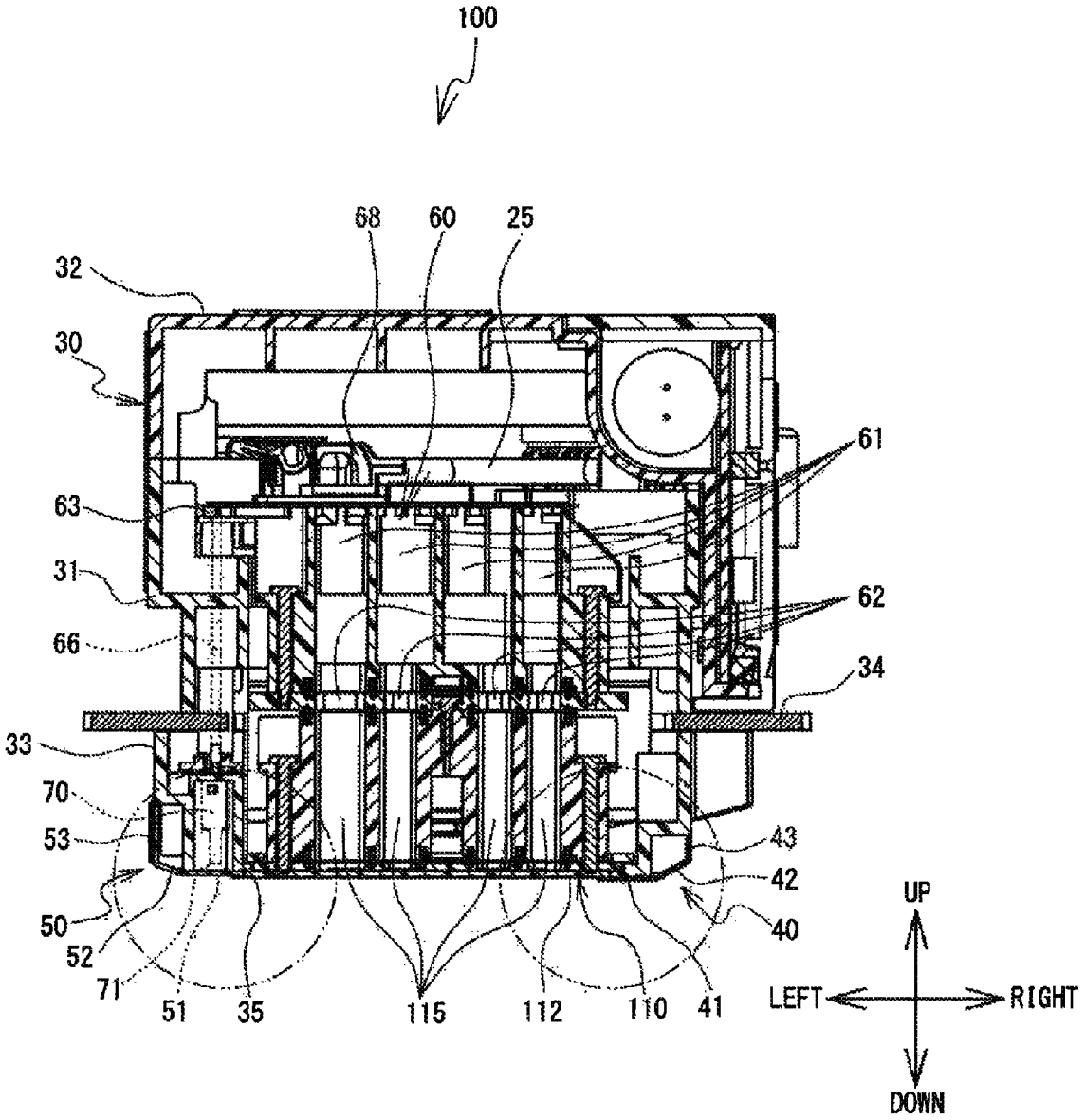
FIG. 7 is a section view of the head unit from the direction of arrows on a line A-A in FIG. 2.

As shown in FIG. 7, the head unit 100 is provided with the four supply flow channels 115. The supply flow channels 115 are hollow flow channels for supplying to the head portion 110 the inks that flow out of the first outflow portion 62. The four supply flow channels 115 are arrayed from left to right. Therefore, when the four supply flow channels 115 are connected to the buffer tank 60, the four supply flow channels 115 are located below the first outflow portion 62. The upper ends of the four supply flow channels 115 are connected to the first outflow portion 62, and the lower ends of the four supply flow channels 115 are connected to the head portion 110. Specifically, the four supply flow channels 115 are connected to the buffer tank 60 and to the plurality of the nozzles 111 in the head portion 110.

Figure 8:
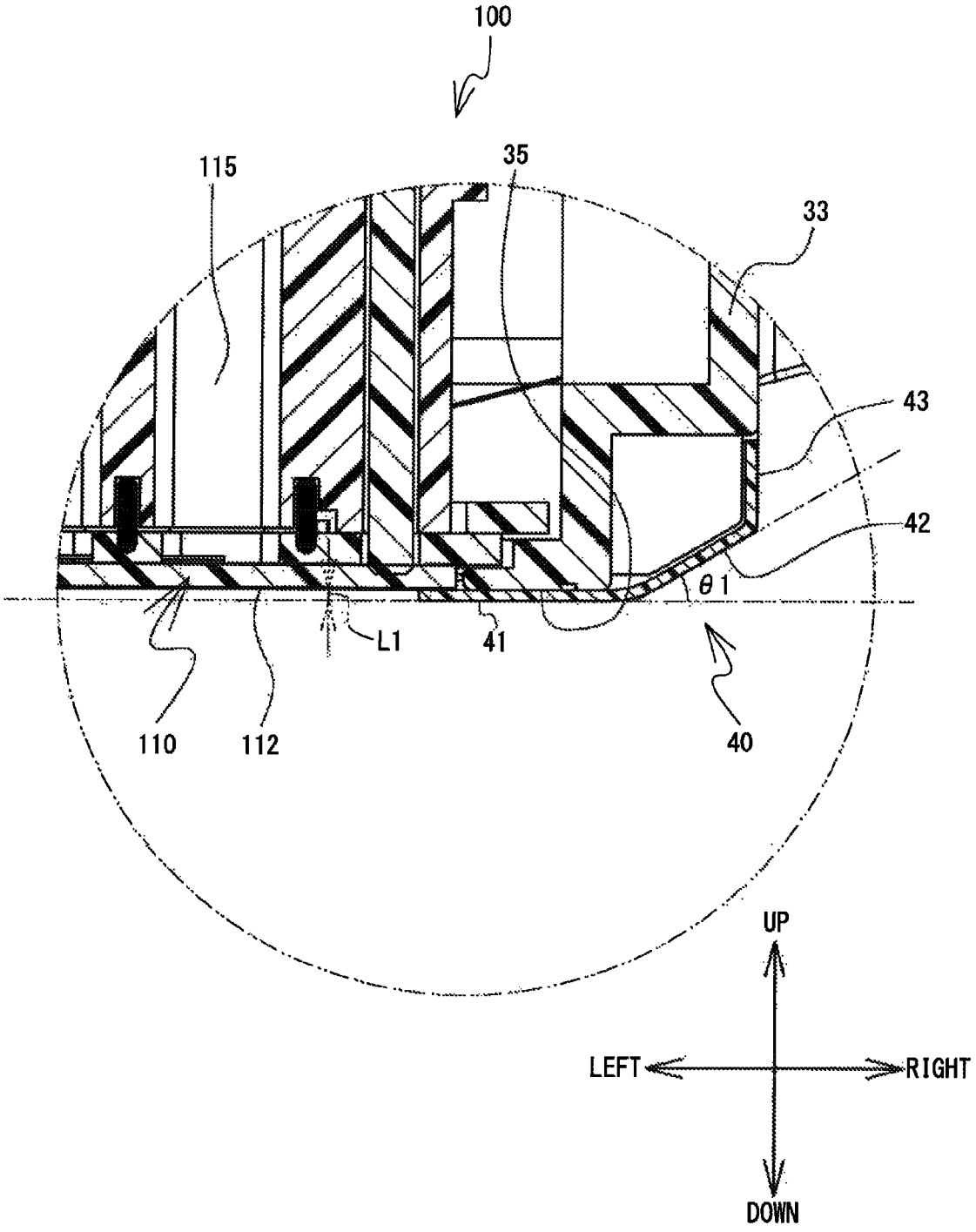
FIG. 8 is an enlarged view of a nozzle guard and the surrounding area in FIG. 7.

As shown in FIG. 8, the nozzle guard 40 is provided with the flat face part 41, a bevel face part 42, and a side face part 43. The nozzle guard 40 comes into contact with the bottom face 35 and the nozzle face 112 from below in a state in which the surface (the outer surface) of the flat face part 41 faces downward. The nozzle guard 40 comes into contact with the bottom face 35 and the nozzle face 112 at substantially the same position in the up-down direction. Therefore, the positions of the flat face part 41 and the nozzle face 112 in the up-down direction are different. The flat face part 41 is located lower than the nozzle face 112. The distance between the surface of the flat face part 41 and the nozzle face 112 in the up-down direction is defined as a distance L1. The distance L1 may be 0.1 millimeters, for example. The distance L1 is equivalent to the thickness of the flat face part 41 in the up-down direction. A fluorine coating process is performed on the surfaces of the flat face part 41, the bevel face part 42, and the side face part 43 by exposing them to fluorine gas, coating them with a fluorine paint, or the like. The fluorine coating process makes the surfaces of the flat face part 41, the bevel face part 42, and the side face part 43 water-repellent. Therefore, liquids that are used in the printer 1, such as the inks, processing agents for discharge printing, cleaning liquids for the head portion 110, and the like, tend to be difficult to adhere to the surfaces of the flat face part 41, the bevel face part 42, and the side face part 43.

The bevel face part 42 is continuous with the right side of the flat face part 41 and extends upward from below as the bevel face part 42 advances toward the right direction away from the flat face part 41. An angle θ1, which is the angle formed by the surface of the bevel face part 42 and the surface of the flat face part 41 may be approximately 30 degrees, for example. The side face part 43 extends in the up-down direction along the right edge of the lower housing 33, and lower edge of the side face part 43 is continuous with the bevel face part 42. The portion where the flat face part 41 and the bevel face part 42 are connected, and the portion where the bevel face part 42 and the side face part 43 are connected, are given gently curved surfaces by bending processes. By covering the right edge of the lower housing 33 with the flat face part 41, the bevel face part 42, and the side face part 43, the nozzle guard 40 reduces possibility to cause damage to the bottom portion of the head unit 100 due to contact with other parts or the like.

Figure 9:
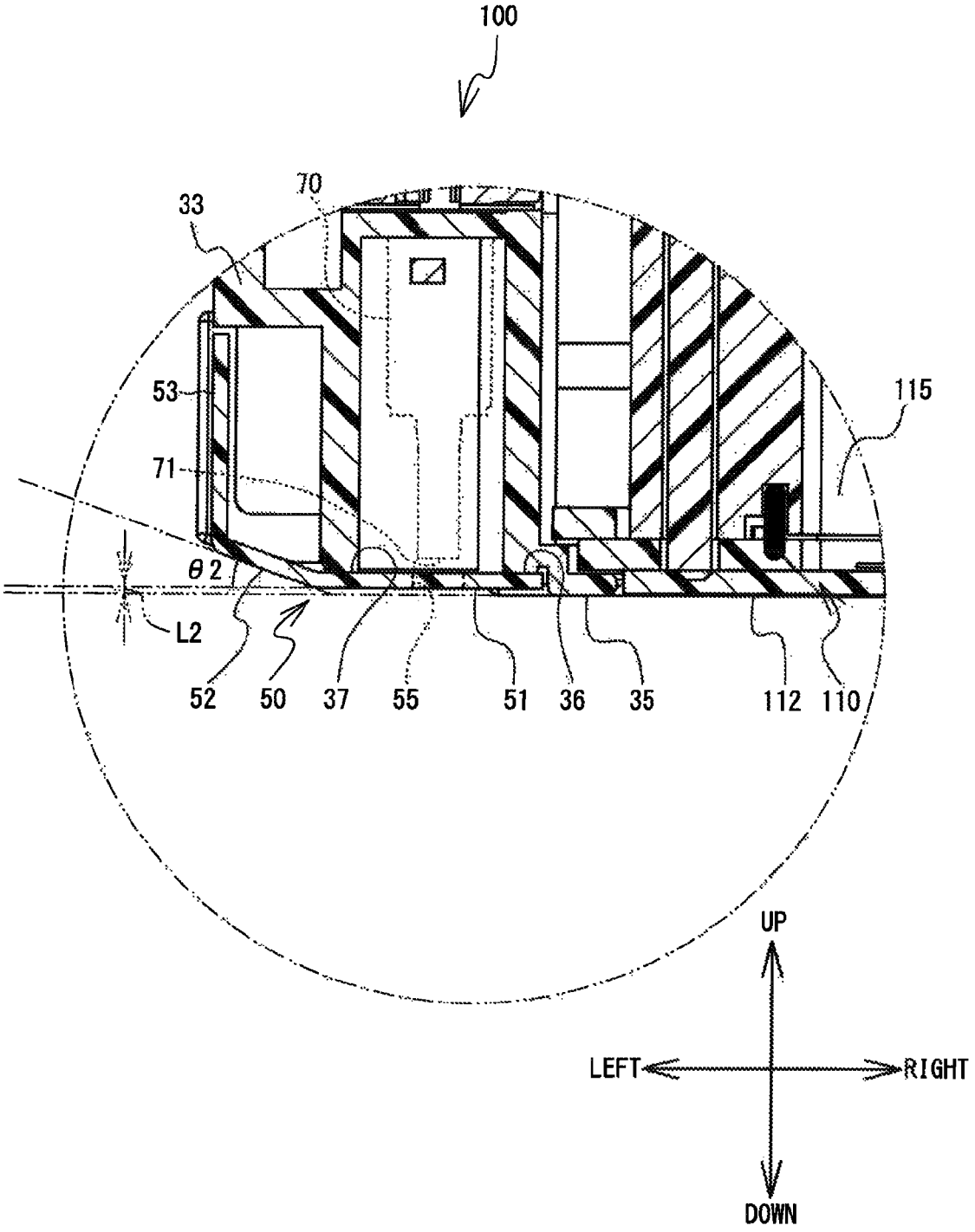
FIG. 9 is an enlarged view of an exhaust guard and the surrounding area in FIG. 7.

As shown in FIG. 9, the exhaust guard 50 is provided with the flat face part 51, a bevel face part 52, and a side face part 53. In a state in which the surface of the flat face part 51 faces downward, the exhaust guard 50 comes into contact with a first flange part 36 and a second flange part 37 of the lower housing 33. The first flange part 36 and the second flange part 37 are located slightly higher than the bottom face 35 among the parts of the lower housing 33. The first flange part 36 and a second flange part 37 are at substantially the same position in the up-down direction. Therefore, the flat face part 51 is parallel to the nozzle face 112 and is located higher than the nozzle face 112. The distance between the surface of the flat face part 51 and the nozzle face 112 in the up-down direction is defined as a distance L2. In the present embodiment, the distance L2 is approximately 0.2 millimeters. The same sort of water repellency processing performed on the surfaces of the flat face part 41, the bevel face part 42, and the side face part 43 of the nozzle guard 40 is performed on the surfaces of the flat face part 51, the bevel face part 52, and the side face part 53, so the surfaces of the flat face part 51, the bevel face part 52, and the side face part 53 are water-repellent.

The bevel face part 52 is continuous with the left side of the flat face part 51 and extends upward from below as the bevel face part 52 advances toward the left direction away from the flat face part 51. An angle θ2, which is the angle formed by the surface of the bevel face part 52 and the surface of the flat face part 51 may be approximately 20 degrees, for example. The side face part 53 extends in the up-down direction along the left edge of the lower housing 33, and lower edge of the side face part 53 is continuous with the bevel face part 52. The portion where the flat face part 51 and the bevel face part 52 are connected, and the portion where the bevel face part 52 and the side face part 53 are connected, are given gently curved surfaces by bending processes. By covering the left edge of the lower housing 33 with the flat face part 51, the bevel face part 52, and the side face part 53, the exhaust guard 50 reduces possibility to cause damage to the bottom portion of the head unit 100 due to contact with other parts or the like.

The configurations and the maintenance operations of the maintenance portions 141, 142 will be explained with reference to FIGS. 2, 10, and 11. The maintenance operations on the head units 100, 200 are performed in the maintenance portions 141, 142. The configurations of the maintenance portions 141, 142 and the maintenance operations that are performed there are the same, so in the explanation that follows, the explanation for the maintenance portion 142 will be omitted as appropriate.

Figure 10:
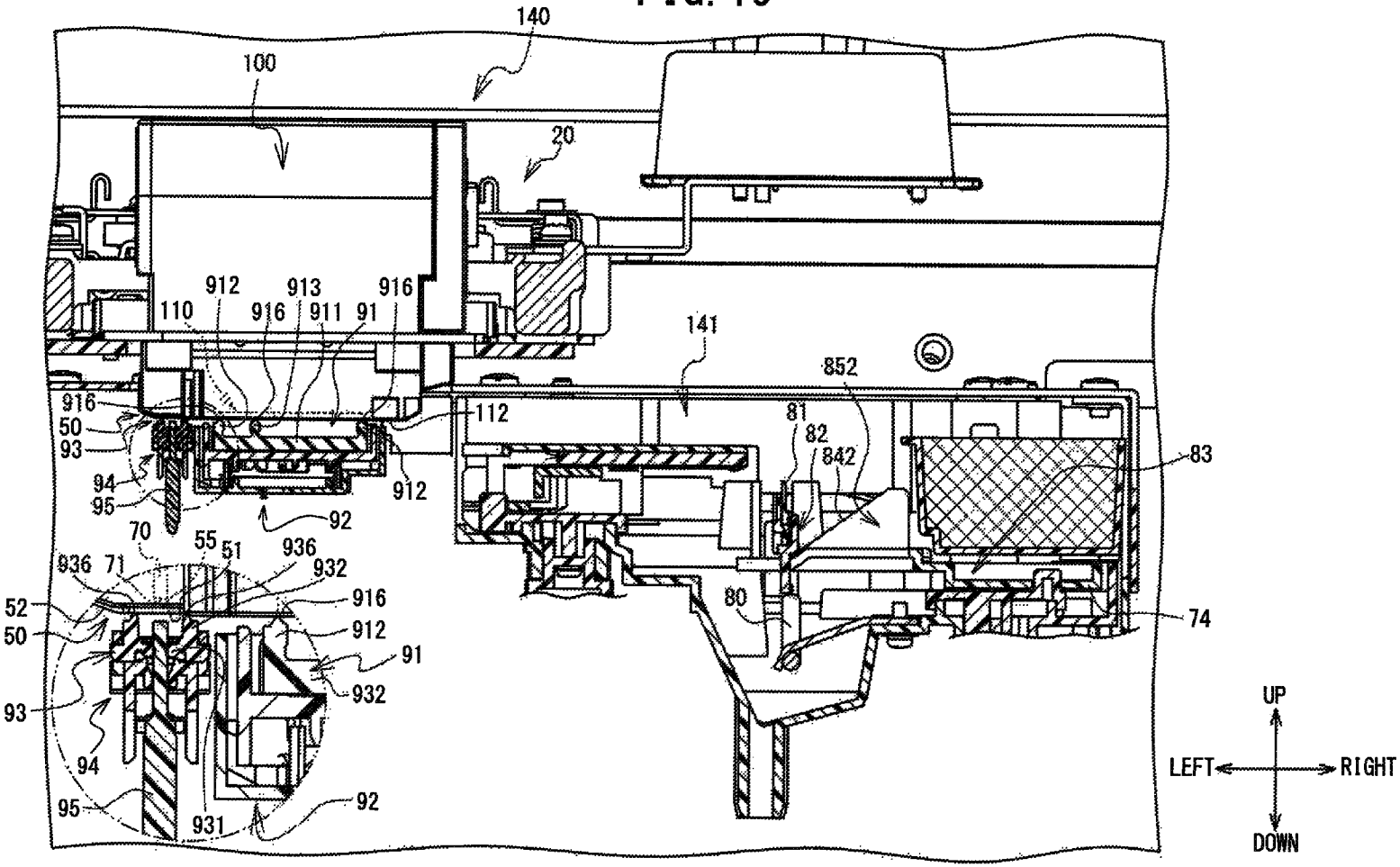
FIG. 10 is a section view from the direction of arrows on a line B-B in FIG. 2, showing a state in which purging is performed.

As shown in FIGS. 2 and 10, the maintenance portion 141 is provided with the wiper 81, a nozzle cap 91, an exhaust cap 93, and the like. The wiper 81 is an elastic body that extends in the front-rear direction approximately in the center of the maintenance portion 141. The wiper 81 is located below the nozzle face 112 when the head unit 100 has moved to the non-printing area 140. The wiper 81 is made of a synthetic resin such as rubber or the like. The upper edge of the wiper 81 is parallel to the nozzle face 112. A wiper support portion 82 is provided on the bottom side of the wiper 81 and supports the wiper 81. The wiper support portion 82 is formed into a rectangular shape whose long axis extends in the front-rear direction when viewed from the left. The wiper support portion 82 has a specified width in the left-right direction. The bottom of the wiper support portion 82 comes into contact with the inclined portions 841, 842 such that the wiper support portion 82 is able to move in relation to inclined portions 841, 842 provided on a transport portion 83. The wiper support portion 82 is energized downward by a coil spring 80 affixed to the bottom of the wiper support portion 82. The transport portion 83 is provided with mutually opposed wall portions 851, 852 and with a wall portion 74 (refer to FIG. 10). The pair of the mutually opposed wall portions 851, 852 are each formed into a substantially triangular shape in a side view and face one another in the front-rear direction. The wall portion 74 is connected to a drive portion that is not shown in the drawings and is moved to the left and the right by the operation of the drive portion. The wiper support portion 82 moves up and down along the inclined portions 841, 842 in conjunction with the movement of the transport portion 83 to the right and the left.

As shown in FIG. 10, the nozzle cap 91 and the exhaust cap 93 are parts that are used for purging and provided in the left portion of the maintenance portion 141. The nozzle cap 91 is made of a synthetic resin such as silicon rubber or the like, for example. The nozzle cap 91 is provided with a bottom wall 911, a perimeter wall 912, and a partition wall 913. The nozzle cap 91 is located on the inner side of a nozzle cap support portion 92 that supports the nozzle cap 91. The nozzle cap support portion 92 has a box shape that is rectangular in a plan view, and its top side is open. The bottom wall 911 is a plate-shaped wall portion that extends horizontally and forms the bottom of the nozzle cap 91. The bottom wall 911 has a rectangular shape along the inner face of the nozzle cap support portion 92 in a plan view. The perimeter wall 912 is a wall portion that is provided on the top side of the bottom wall 911, which is the side of the nozzle cap 91 facing the nozzle face 112. The perimeter wall 912 extends upward from the outer edges of the bottom wall 911. The perimeter wall 912 faces a periphery of the nozzle face 112 in the up-down direction. The periphery of the nozzle face 112 surrounds an area, in which a plurality of the nozzles 111 are formed, of the nozzle face 112. The nozzle cap 91, by covering the nozzle face 112 when printing is not being performed, seals the plurality of the nozzles 111 against the outside air. The nozzle cap 91 thus plays a role in decreasing possibility to cause the ink to increase the viscosity by the reasons such as vaporizing the constituents of the ink inside the nozzles 111 and to cause printing defects.

The partition wall 913 is a wall portion that is provided on the top side of the bottom wall 911, which is the side of the nozzle cap 91 facing the nozzle face 112. The partition wall 913 extends upward from the bottom wall 911. The partition wall 913 is provided between the left edge of the bottom wall 911 and the center of the bottom wall 911 in the left-right direction. The partition wall 913 extends from the front to the rear of the bottom wall 911. The front end and the rear end of the partition wall 913 are each connected to the perimeter wall 912. The perimeter wall 912 and the partition wall 913 are of an equal and uniform height, and a cap lip 916, which is formed by the upper edges of the perimeter wall 912 and the partition wall 913, is located at a height higher than the upper edge of the nozzle cap support portion 92.

The exhaust cap 93 is made of a synthetic resin such as silicon rubber or the like, for example. The exhaust cap 93 is provided with a bottom wall 931 and a perimeter wall 932. The exhaust cap 93 is located on the inner side of an exhaust cap support portion 94 that supports the exhaust cap 93. The exhaust cap support portion 94 has a box shape that is rectangular in a plan view, and its top side is open. The bottom wall 931 is a plate-shaped wall portion that extends horizontally and forms the bottom of the exhaust cap 93. The bottom wall 931 has a rectangular shape along the inner face of the exhaust cap support portion 94 in a plan view. Four pins 95 that extend through the bottom wall 931 in the up-down direction are arrayed in the front-rear direction in the center of the left-right direction of the bottom wall 931. The perimeter wall 932 is a wall portion provided on the top side of the exhaust cap 93, which is the side of the exhaust cap 93 facing the flat face part 51 of the exhaust guard 50. The perimeter wall 932 extends upward from the outer edges of the bottom wall 931. The perimeter wall 932 faces a periphery of the flat face part 51 in the up-down direction. The periphery of the flat face part 51 surrounds an area, in which four openings 55 are formed, of the flat face part 51. The perimeter wall 932 is of a uniform height, and a cap lip 936, which is formed by the upper edge of the perimeter wall 932, is located at a height higher than the upper edge of the exhaust cap support portion 94.

The nozzle cap support portion 92 and the exhaust cap support portion 94 are connected to a drive portion that is not shown in the drawings. The nozzle cap support portion 92 and the exhaust cap support portion 94 move up and down by the operation of the drive portion. The nozzle cap 91 and the exhaust cap 93 move up and down as single units with the nozzle cap support portion 92 and the exhaust cap support portion 94, respectively. As shown in FIG. 10, when the nozzle cap 91 and the exhaust cap 93 have moved up and the head unit 100 has moved to the non-printing area 140, the nozzle cap 91 and the exhaust cap 93 are in tight contact with the bottom of the head unit 100. At this time, the cap lip 916 of the nozzle cap 91 is in tight contact with the periphery of the nozzle face 112. The periphery of the nozzle face 112 surrounds the area of the nozzle face 112 in which the plurality of the nozzles 111 are provided. Then the nozzle cap 91 covers the plurality of the nozzles 111. The cap lip 936 of the exhaust cap 93 is in tight contact with the periphery of the flat face part 51 of the exhaust guard 50. The periphery of the flat face part 51 surrounds the area of the flat face part 51M which the four openings 55 are provided. Then the exhaust cap 93 covers the four openings 55. Also, the exhaust cap 93 covers the exhaust outlets 71 that are located inside the four openings 55. A suction pump that is not shown in the drawings that can be selectively connected to the nozzle cap 91 and the exhaust cap 93 is provided in the maintenance portion 141.

When a suction operation is performed by operating the suction pump in a state in which the suction pump is connected to the nozzle cap 91, the air in the sealed space between the nozzle cap 91 and the nozzle face 112 is sucked out, and the pressure in the sealed space decreases. Suction purging is thus performed, causing the ink in the interior of the head portion 110 to be expelled from the plurality of the nozzles 111. Depending on the types of constituents that are contained in the ink, such as synthetic resins and the like, and depending on the use environment for the printer 1, cases may occur in which the ink inside the nozzles 111 becomes more viscous or hardens and binds to the nozzles 111. By performing suction purging, the printer 1 is able to restore the printing quality by expelling from the plurality of the nozzles 111, along with the ink, foreign matter such as viscosity-increased ink or the like, as well as gas bubbles or the like that have entered into the interior of the head portion 110.

In a state in which the exhaust cap 93 is in tight contact with the flat face part 51, the four pins 95 are able to move up and down as a single unit in a state in which an airtight seal is maintained between the exhaust cap 93 and the flat face part 51. If the four pins 95 move upward while the exhaust cap 93 is covering the exhaust outlets 71 that are located inside the four openings 55, opening valves that are provided inside the exhaust portions 70 are pushed upward by the pins 95, and the flow channels in the interiors of the exhaust portions 70 are opened. The suction operation is performed in this state. In the suction operation, the suction pump operates in a state in which it is connected to the exhaust cap 93. The air in the sealed space between the exhaust cap 93 and the flat face part 51 is thus sucked out, and the pressure in the sealed space decreases. Exhaust purging is thus performed. The ink that have accumulated in the buffer tank 60 and contains the gas bubbles is expelled from the exhaust outlets 71. The performing of exhaust purging causes the interior of the buffer tank 60 to be filled with ink. The printer 1 is thus able to decrease possibility to cause a decrease in printing quality that is due to problems with the discharge of the ink. By performing the exhaust purging when the ink is first introduced, for example, the printer 1 expels the air in the buffer tank 60 from the exhaust outlets 71 through the exhaust flow channel portion 65 and the exhaust portions 70. In conjunction with the discharge of the air, the ink is introduced into the buffer tank 60 from the main tank through the tubes 25 and the connection units 26.

Figure 11:
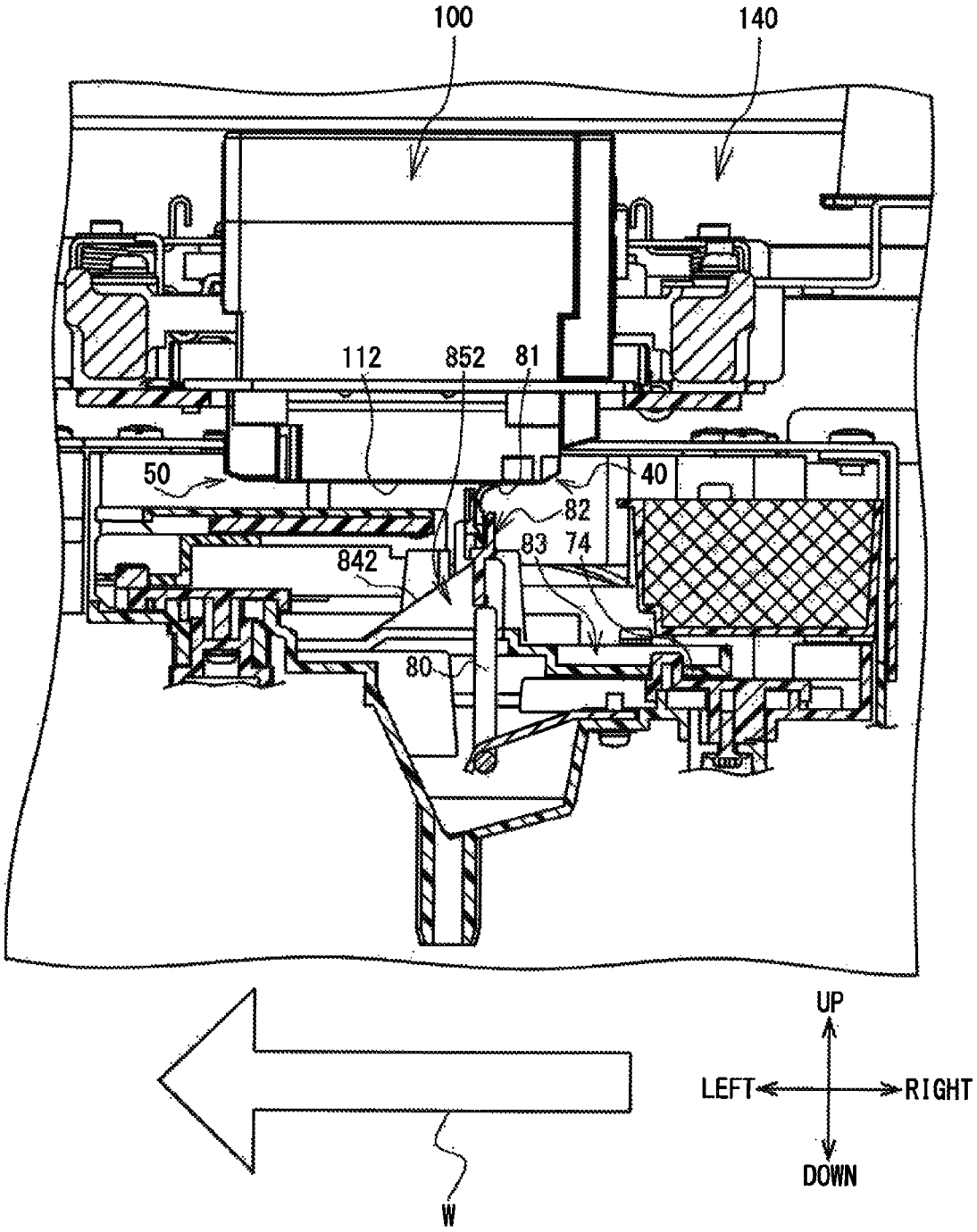
FIG. 11 is a section view from the direction of the arrows on the line B-B in FIG. 2, showing a state in which wiping of a nozzle face is performed.

As shown in FIG. 11, the printer 1, by moving the transport portion 83 to the left, puts the bottom of the wiper support portion 82 in a position where the bottom of the wiper support portion 82 is in contact with the upper ends of the inclined portions 841, 842. In conjunction with this movement, the wiper support portion 82, having moved upward, brings the upper edge of the wiper 81 into contact with the bottom of the head unit 100 from below. In the state in which the upper edge of the wiper 81 is in contact with the bottom of the head unit 100, the movement of the carriage 20 to the right causes the upper edge of the wiper 81 to slide from the right side to the left side on the bottom surfaces of the nozzle guard 40, the nozzle face 112, and the exhaust guard 50, in that order. In this manner, nozzle face wiping is performed. Inks and the like that are adhering to the bottom of the head unit 100 are removed in the direction that is indicated by the arrow W. Performing nozzle face wiping makes it possible for the printer 1 to reduce the possibility that it will become more difficult for ink to be discharged from the plurality of the nozzles 111 due to hardening and adhesion of ink that remains on the nozzle face 112, for example.

The relationship between the maintenance operations and the shapes of the individual parts on the bottom of head unit 100 will be explained with reference to FIGS. 8 to 11. As shown in FIG. 11, in the nozzle face wiping operation, the wiper 81 slides along the bottoms of the nozzle guard 40, the nozzle face 112, and the exhaust guard 50, in that order, while in an elastically deformed state.

The upper edge of the wiper 81, which moves toward the bottom of the head unit 100 in the direction of the arrow W, first comes into contact with the nozzle guard 40. As shown in FIG. 8, the nozzle guard 40 includes the side face part 43 and the bevel face part 42, which cover the right edge of the lower housing 33. Therefore, in the nozzle face wiping operation, as the upper edge of the wiper 81 moves toward the lower housing 33 in the direction of the arrow W, the upper edge of the wiper 81 first comes up against the bevel face part 42 of the nozzle guard 40. In some cases, ink is adhering to the wiper 81 from an earlier round of nozzle face wiping. Assume a case in which the bevel face part 42 is not formed on the nozzle guard 40, and the side face part 43 is continuous with the flat face part 41. After first coming into contact with the side face part 43, the wiper 81 slides toward the flat face part 41. In this case, ink that is adhering to the wiper 81 will, for example, tend to rub off on the side face part 43 and accumulate on the side face part 43. When ink accumulates in a specific location on the nozzle guard 40, there is a possibility that the accumulated ink will drip off during printing, for example, thereby impairing the printing quality. When ink accumulates on the side face part 43, there is a possibility that the ink that has accumulated on the side face part 43 will once again adhere to the wiper 81. In the present embodiment, the bevel face part 42 is formed in the area where the wiper 81 first comes into contact with the nozzle guard 40. Therefore, the ink that is adhering to the wiper 81 is carried toward the flat face part 41 after the wiper 81 comes up against the bevel face part 42. The surfaces of the bevel face part 42 and the flat face part 41 are water-repellent (ink-repellent), so the ink tends to be difficult to stick to the bevel face part 42 and the flat face part 41. Therefore, the ink that adheres to the bevel face part 42 and the flat face part 41 is easily removed by the wiper 81. Accordingly, the printer 1 is able to decrease possibility to cause a decrease in the printing quality by making it harder for ink to accumulate and to become concentrated in the specific location on the nozzle guard 40.

The ink that has been carried from the bevel face part 42 to the flat face part 41 is further carried toward the nozzle face 112 by the sliding of the wiper 81 along the nozzle guard 40. Assume a case in which the nozzle face 112 is located lower than the flat face part 41 (a case in which the nozzle face 112 is located in the direction in which the head unit 100 comes to be relatively closer to the upper edge of the wiper 81). In that case, the ink that has accumulated on the wiper 81 would be rubbed off and tend to accumulate at the boundary between the flat face part 41 and the nozzle face 112. If the accumulated ink spreads into the area where the plurality of the nozzles 111 are located, for example, there is a possibility that it would give rise to problems in printing, such as mixing in with the colors of the inks in the nozzles 111, clogging of the nozzles 111 by hardened ink, and the like. Furthermore, if ink (including ink that has become more viscous or has hardened) remains on the nozzle face 112, there is a possibility that the tight contact between the nozzle cap 91 and the nozzle face 112 will be impaired during the suction purging operation, such that the suction purging operation becomes inadequate. When the tight contact between the nozzle cap 91 and the nozzle face 112 is impaired, there is also a possibility that the plurality of the nozzles 111 will not be adequately sealed by the nozzle cap 91 when printing is not being performed, such that the plurality of the nozzles 111 become more susceptible to the effects of the external environment. In the present embodiment, the nozzle face 112 is located higher than the flat face part 41 (the nozzle face 112 is located in the direction in which the head unit 100 is relatively farther the upper edge of the wiper 81) by the distance L1. Therefore, ink is less likely to accumulate at the boundary between the flat face part 41 and the nozzle face 112, and the printer 1 is able to decrease the occurrence of problems with the discharge of the ink.

The wiper 81 moves in the direction of the arrow W in relation to the nozzle face 112 while sliding on the nozzle face 112. At this time, the wiper 81 moves the ink, that has adhered to the nozzle face 112 during printing and the like, toward the left side of the nozzle face 112, along with the ink that has been carried from the nozzle guard 40. The ink that has been carried to the left edge of the nozzle face 112 is then further carried toward the flat face part 51 of the exhaust guard 50 by the wiper 81 as it slides to the left. Assume a case in which the flat face part 51 is located lower than the nozzle face 112 (a case in which the flat face part 51 is located in the direction in which the head unit 100 comes to be relatively closer to the upper edge of the wiper 81). In that case, the ink that has adhered to the wiper 81 would be rubbed off and tend to accumulate at the boundary between the nozzle face 112 and the flat face part 51. In the present embodiment, as shown in FIG. 9, the flat face part 51 is located higher than the nozzle face 112 (the flat face part 51 is located in the direction in which the head unit 100 is relatively farther the upper edge of the wiper 81) by the distance L2. Therefore, ink is less likely to accumulate at the boundary between the nozzle face 112 and the flat face part 51. By making it harder for the ink to accumulate at the boundary between the nozzle face 112 and the flat face part 51, the printer 1 is able to make it less likely that the ink will remain on the nozzle face 112 in the nozzle face wiping operation. The printer 1 is able to decrease possibility to cause discharge problems in the head portion 110 and to cause inadequate suction purging. The printer 1 is therefore able to ensure good printing quality.

The ink that has been carried toward the flat face part 51 from the nozzle face 112 is then carried toward the bevel face part 52 by the wiper 81 as the wiper 81 moves farther to the left in relation to the nozzle face 112. The surfaces of the flat face part 51 and the bevel face part 52 are water-repellent (ink-repellent), so the ink tends to be difficult to stick to the flat face part 51 and the bevel face part 52. Therefore, the ink that adheres to the flat face part 51 and the bevel face part 52 is easily removed by the wiper 81. When the wiper 81 moves from the flat face part 51 toward the bevel face part 52, the wiper 81 slowly returns to its original shape (refer to FIG. 10) from the elastically deformed state as the wiper 81 slides on the sloping surface of the bevel face part 52. Thereafter, the wiper 81 moves farther to the left, beyond the bevel face part 52, and moves away from the exhaust guard 50. Assume a case in which the bevel face part 52 continuous with the flat face part 51 is not provided and the flat face part 51 is continuous with the side face part 53. The wiper 81 would return to its original shape from the elastically deformed state very abruptly when the wiper 81 moves away from the exhaust guard 50. In that case, the force with which the wiper 81 returns to its original shape would tend to cause any ink that is adhering to the wiper 81 to be splattered in the area around the wiper 81. If the ink that was splattered from the wiper 81 were to adhere to the nozzle face 112 and the like once again, there is a possibility that it would cause a decrease in the printing quality due to problems with the discharge of the ink or the like. In the present embodiment, the bevel face part 52 is formed in the portion of the exhaust guard 50 with which the wiper 81 comes into contact last. It is therefore possible to inhibit the ink that is adhering to the wiper 81 from being splattered by the force with which the wiper 81 returns to its original shape. The printer 1 is thus able to decrease possibility to cause a decrease in the printing quality.

The force with which the wiper 81 returns to its original shape when the wiper 81 moves away from the exhaust guard 50 diminishes as the slope of the surface of the bevel face part 52 becomes gentler in relation to the flat face part 51. Decreasing the force with which the wiper 81 returns to its original shape enables the printer 1 to decrease the extent to which the ink that is adhering to the wiper 81 is splattered in the area around the wiper 81. As shown in FIGS. 8 and 9, the angle θ2 that is formed by the surface of the bevel face part 52 and the surface of the flat face part 51 is smaller than the angle θ1 that is formed by the surface of the bevel face part 42 and the surface of the flat face part 41. In the printer 1, the slope of the surface of the bevel face part 52 in relation to the surface of the flat face part 51 is comparatively gentle. The printer 1 is able to decrease possibility to cause problems due to the splattering of ink inside the printer 1, particularly the problem of the re-adhering of ink to the nozzle face 112. Therefore, the printer 1 is able to decrease possibility to cause a decrease in the printing quality.

Among the flat face part 41, the nozzle face 112, and the flat face part 51, the flat face part 41 is located the lowest. The nozzle face 112 is located higher than the surface of the flat face part 41 by the distance L1, and the surface of the flat face part 51 is located higher than the nozzle face 112 by the distance L2. The elastic deformation of the wiper 81 is the greatest when the wiper 81 slides on the flat face part 41, which, among the flat face part 41, the nozzle face 112, and the flat face part 51, is the closest to the wiper 81. Thereafter, the elastic deformation of the wiper 81 slowly eases as the wiper 81 slides on the nozzle face 112 and the flat face part 51. The easing of the elastic deformation of the wiper 81 proceeds slowly until the wiper 81 reaches the bevel face part 52, so the printer 1 is able to decrease the splattering of the ink inside the printer 1.

On the bottom of the head unit 100, the exhaust guard 50 is the portion along which the wiper 81 slides last in the nozzle face wiping operation. Therefore, the ink that has been removed from the nozzle guard 40 and the nozzle face 112 tends to accumulate on the exhaust guard 50. In a case where a large amount of ink is concentrated on the exhaust guard 50, there is a possibility that the ink will not be completely removed from the exhaust guard 50 by the nozzle face wiping operation. When exhaust purging is performed in a state in which there is ink remaining on the exhaust guard 50, some ink may remain on the flat face part 51, along the cap lip 936 of the exhaust cap 93, which is in contact with the flat face part 51, after the exhaust purging operation is finished. In the present embodiment, the surface of the flat face part 51 is located higher than the nozzle face 112 by the distance L2 and is located higher than the surface of the flat face part 41 of the nozzle guard 40 by the sum of the distance L1 and the distance L2. In the printer 1, during printing, the holding face 5A of the platen 5 is located opposite the bottom of the head unit 100 (refer to FIG. 1). Specifically, the flat face part 51 is located in the farthest position in the upper direction from the holding face 5A on the bottom of the head unit 100. Accordingly, even if it is assumed that ink remains on the flat face part 51, the printer 1 is able to decrease the possibility that the ink that remains on the flat face part 51 during printing will mistakenly adhere to the print medium placed on the holding face 5A. The printer 1 is therefore able to decrease possibility to cause a decrease in the printing quality.

As explained previously, in the present embodiment, the lower housing 33 supports the head portion 110 from above, in a state in which the nozzle face 112 faces downward. The right edge of the bottom face 35 of the lower housing 33 is covered by the nozzle guard 40. The nozzle guard 40 includes the flat face part 41 which is located lower than the nozzle face 112 and parallel to the nozzle face 112. The left edge of the bottom face 35 is covered by the exhaust guard 50. The exhaust guard 50 includes the flat face part 51 which is located higher than the nozzle face 112 and parallel to the nozzle face 112. The wiper 81 is slidably in contact with the bottom face 35 from below and moves from the right side to the left side in relation to the bottom of the head unit 100. The wiper 81 is thus able to move the ink that is adhering to the bottom of the head unit 100 (for example, the nozzle face 112) from the flat face part 41, across the nozzle face 112, and to the flat face part 51. As the wiper 81 moves from the right side to the left side in relation to the bottom of the head unit 100, the position on the bottom of the head unit 100 where the wiper 81 is sliding changes from lower to higher, in a direction away from the wiper 81. Therefore, particularly the ink that is wiped off of the nozzle face 112 and moved by the wiper 81 is not blocked by the flat face part 51 and can be easily removed from the nozzle face 112 toward the left. Accordingly, the printer 1 is able to reduce any decrease in the printing quality that is due to ink remaining on the nozzle face 112.

During the current round of nozzle face wiping, it may be the case that ink is already adhering to the wiper 81 from its having slid along the bottom of the head unit 100 in previous rounds. In the nozzle face wiping operation, as the upper edge of the wiper 81 approaches the lower housing 33 from the right, the upper edge of the wiper 81 is first received by the bevel face part 42 of the nozzle guard 40 and then moves toward the flat face part 41. Therefore, the ink adhering to the wiper 81 is carried toward the flat face part 41 by the wiper 81 without being rubbed off by the side face part 43 or the like. That is, the concentrating in a specific location on the nozzle guard 40 of ink that has been rubbed off of the wiper 81 is effectively inhibited. The wiper 81, having moved toward the left edge of the bottom of the head unit 100, slowly moves away from the lower housing 33 as the wiper 81 slides on the flat face part 51 and the bevel face part 52. Thus, when the wiper 81 is moving away from the lower housing 33, it is possible to inhibit the ink that is adhering to the wiper 81 from splattering in the area around the wiper 81, such as the nozzle face 112 and the like. The printer 1 is therefore able to inhibit the ink that has been wiped off of the nozzle face 112 from once again adhering to the nozzle face 112 and remaining there.

The angle θ2 that is formed by the surface of the bevel face part 52 and the surface of the flat face part 51 is smaller than the angle θ1 that is formed by the surface of the bevel face part 42 and the surface of the flat face part 41. In other words, in this case, the slope of the surface of the bevel face part 52 in relation to the surface of the flat face part 51 is gentler than the slope of the surface of the bevel face part 42 in relation to the surface of the flat face part 41. Accordingly, in the nozzle face wiping operation, the wiper 81, having moved to the left edge of the bottom of the head unit 100, gradually moves away from the lower housing 33. The printer 1 is therefore able to effectively inhibit the ink that is adhering to the wiper 81 from splattering when the wiper 81 moves away from the bevel face part 52.

The nozzle guard 40 and the exhaust guard 50 are formed as separate units from the lower housing 33. Therefore, according to the printer 1, the productivity of the head unit 100 is improved. The surfaces of the flat face part 41, the bevel face part 42, and the side face part 43 of the nozzle guard 40, as well as the surfaces of the flat face part 51, the bevel face part 52, and the side face part 53 of the exhaust guard 50, are water-repellent. Therefore, it is difficult for liquids to remain on the nozzle guard 40 and the exhaust guard 50, and the wiper 81 can reliably remove the ink from the nozzle guard 40, the nozzle face 112, and the exhaust guard 50.

The lower housing 33 is made of a synthetic resin that is reinforced with glass fiber. In the printer 1, each of the parts of the housing 30 is made from a synthetic resin with superior workability. Therefore, according to the printer 1, the productivity of the head unit 100 is improved. In the process that imparts water repellency such as fluorine coating, heat treatment at a comparatively high temperature is necessary in some cases. However, the nozzle guard 40 and the exhaust guard 50 are made of stainless steel (SUS), so they are able to endure the heat treatment. It is therefore preferable for the water repellency processing to be performed on the nozzle guard 40 and the exhaust guard 50.

The four exhaust portions 70 are provided on the base 38 of the lower housing 33. The four exhaust portions 70 are provided with the internal flow channels for expelling, along with the ink, bubbles of air and the like that stay inside the buffer tank 60. The four exhaust outlets 71 that serve as outlets for the internal flow channels of the exhaust portions 70 are provided on the lower ends of the four exhaust portions 70. The accumulation of ink around the four exhaust outlets 71 causes to lower the coverage of the exhaust outlets 71 by the exhaust cap 93 and create the possibility that exhaust purging will not be performed adequately. By covering the left edge of the lower housing 33 while leaving the four exhaust outlets 71 downwardly exposed through the four openings 55 in the flat face part 51, the exhaust guard 50 is able to reduce the accumulation of ink around the four exhaust outlets 71.

The four exhaust outlets 71 are provided to open at the bottom face 35 and arrayed in the front-rear direction to the left of the head portion 110. The four openings 55 through which the four exhaust outlets 71 are downwardly exposed are provided in the flat face part 51. The flat face part 51 is located in a position farther away from the holding face 5A of the platen 5 in the upper direction than positions of the surfaces of the nozzle face 112 and the flat face part 41. Therefore, even if it is assumed that ink remains around the four openings 55 in the flat face part 51, the printer 1 is able to decrease the possibility that the ink that remains on the flat face part 51 will mistakenly adhere to the print medium placed on the holding face 5A.

The present disclosure is not limited to the embodiment that is described above, and various types of modifications can be made to the embodiment that is described above. For example, in the embodiment that is described above, the nozzle guard 40 and the exhaust guard 50 are formed as separate parts, but the nozzle guard 40 and the exhaust guard 50 may also be formed as a single unit. The nozzle guard 40 and the exhaust guard 50 may also be formed from a synthetic resin. The lower housing 33 may also be formed from metal. Furthermore, in the embodiment that is described above, the nozzle guard 40 and the exhaust guard 50 are formed as separate units from the lower housing 33, but the nozzle guard 40 and the exhaust guard 50 may also be formed as a single unit with the lower housing 33. For example, die casting may be used to cast the nozzle guard 40 and the exhaust guard 50 from metal as a single unit with the lower housing 33. The nozzle guard 40 and the exhaust guard 50 may also be formed as a single unit with the lower housing 33 by injection molding of a synthetic resin.

In the embodiment that is described above, the surfaces of the flat face part 41, the bevel face part 42, and the side face part 43 of the nozzle guard 40, and the surfaces of the flat face part 51, the bevel face part 52, and the side face part 53 of the exhaust guard 50, are water-repellent. It is acceptable for reverse faces on the opposite side of the surfaces of the flat face part 41, the bevel face part 42, and the side face part 43 of the nozzle guard 40 (the surfaces that are in contact with the lower housing 33) not to be water-repellent. It is also acceptable for reverse faces on the opposite side of the surfaces of the flat face part 51, the bevel face part 52, and the side face part 53 of the exhaust guard 50 (the surfaces that are in contact with the lower housing 33) not to be water-repellent. On the nozzle guard 40, the surfaces of at least the flat face part 41 and the bevel face part 42, on which the wiper 81 slides, must be water-repellent. On the exhaust guard 50, the surfaces of at least the flat face part 51 and the bevel face part 52, on which the wiper 81 slides, must be water-repellent. On the nozzle guard 40 and the exhaust guard 50, at least the flat face part 41 and the flat face part 51, which are parallel to the nozzle face 112, must be water-repellent. Instead of the fluorine coating process, the surfaces of the nozzle guard 40 and the exhaust guard 50 may also be made water-repellent a different water repellency process, such as the forming of a plating film, for example, on the surfaces of the nozzle guard 40 and the exhaust guard 50. Instead of surface treatments such as the fluorine coating process, the plating film, or the like, the surfaces of the nozzle guard 40 and the exhaust guard 50 may be made water-repellent by making the surfaces of the metal base material smoother. In a case where the nozzle guard 40 and the exhaust guard 50 are made of a synthetic resin, the surfaces of the nozzle guard 40 and the exhaust guard 50 may be made water-repellent by coating them with a water-repellent material. Instead of using a surface coating, the surfaces of the nozzle guard 40 and the exhaust guard 50 may also be made water-repellent by making the surface of the synthetic resin base material smoother.

In the embodiment that is described above, the nozzle cap 91 is mainly used for suction purging, the exhaust cap 93 is mainly used for exhaust purging, and the nozzle cap 91 and the exhaust cap 93 are formed as separate caps. The nozzle cap 91 and the exhaust cap 93 may also be formed as a single unit. Specifically, the printer 1 may be provided with one cap unit. Alternatively, the printer 1 may be provided with more than two separate cap units.

The longer the bevel face part 52 becomes in the left-right direction, the more gradually the wiper 81 will be able to return to its original shape from the elastically deformed state as the wiper 81 slides on the bevel face part 52 in the nozzle face wiping operation. The more gradually the wiper 81 returns to its original shape, the less likely it is that the ink adhering to the wiper 81 will be splattered. Therefore, the length of the bevel face part 52 in the left-right direction may be made longer than the length of the example in the embodiment that is described above.

In the embodiment that is described above, the nozzle face wiping operation is performed in such a manner that the carriage 20 moves the head unit 100 to the right after the wiper support portion 82 moves upward and the upper edge of the wiper 81 comes into contact with the bottom of the head unit 100. As a separate example, in the nozzle face wiping operation, the position of the wiper 81 in the up-down direction may be fixed, and the head unit 100 may be moved downward toward the wiper 81, such that the upper edge of the wiper 81 comes into contact with the bottom of the head unit 100. As yet another example, the position of the head unit 100 in the left-right direction may be fixed, and the nozzle face wiping operation may be performed by moving the wiper 81 from the right side to the left side with respect to the bottom of the head unit 100 while the wiper 81 is in contact with the bottom of the head unit 100. As still another example, both the wiper 81 and the bottom of head unit 100 may move in relation to one another in both the up-down direction and the left-right direction, such that the wiper 81 slides on the nozzle face 112. In the nozzle face wiping operation, nozzle face wiping needs only to be performed from the right side to the left side of the nozzle face 112 by the relative movement of the nozzle face 112 and the wiper 81.

In the embodiment that is described above, in the suction purging and exhaust purging operations, the nozzle cap 91 and the exhaust cap 93 are brought into contact with the bottom of the head unit 100 by their upward movement toward the bottom of the head unit 100. The positions of the nozzle cap 91 and the exhaust cap 93 in the up-down direction may also be fixed in a state in which the cap lips 916, 936 are on the respective top sides, for example, and the nozzle cap 91 and the exhaust cap 93 come into contact with the bottom of the head unit 100 when the head unit 100 moves downward toward them. The suction purging and exhaust purging operations may also be performed by moving the nozzle cap 91 and the exhaust cap 93 toward the bottom of the head unit 100 and moving the head unit 100 toward the nozzle cap 91 and the exhaust cap 93.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device, comprising:

a discharge portion including a discharge face on a first direction side, the discharge face having a plurality of discharge outlets formed therein to discharge a liquid to a print medium;

a support portion provided to support the discharge portion on a second direction side, the second direction being the opposite direction from the first direction;

a wiper provided to be able to move from a third direction side to a fourth direction side while in contact with the discharge face from the first direction side, the third direction and the fourth direction orthogonally intersecting the first direction and the second direction, and the fourth direction being the opposite direction from the third direction;

a first cover portion provided to cover an edge on the third direction side of the support portion, the first cover portion provided at a position apart from the print medium, the first cover portion including a first flat face part provided parallel to the discharge face and located to the first direction side of the discharge face, the first flat face part facing in the first direction; and a second cover portion provided to cover an edge on the fourth direction side of the support portion, the second cover portion provided at a position apart from the print medium, the second cover portion including a second flat face part provided parallel to the discharge face and located to the second direction side of the discharge face, the second flat face part facing in the first direction.

2. The print device according to claim 1, wherein the first cover portion includes a first bevel face part, the first bevel face part being continuous with the third direction side of the first flat face part and being extended toward the second direction as the first bevel face part advances toward the third direction away from the first flat face part, and the second cover portion includes a second bevel face part, the second bevel face part being continuous with the fourth direction side of the second flat face part and being extended toward the second direction as the second bevel face part advances toward the fourth direction away from the second first flat face part.

3. The print device according to claim 2, wherein a minor angle formed by the second flat face part and the second bevel face part is larger than a minor angle formed by the first flat face part and the first bevel face part.

4. The print device according to claim 1, wherein the first cover portion and the second cover portion are formed separately from the support portion, and at least a surface on the first direction side of each one of the first cover portion and the second cover portion is water-repellent.

5. The print device according to claim 4, wherein the support portion is made of a synthetic resin, and the first cover portion and the second cover portion are made of metal.

6. The print device according to claim 1, further comprising:

a cap provided to be able to cover the first direction side of the plurality of the discharge outlets;

a liquid supply flow channel located to the second direction side of the support portion, the liquid supply flow channel being provided between the discharge portion and a storage portion in such a manner as to supply the liquid from the storage portion to the discharge portion, the storage portion being configured to store the liquid; and an expeller portion provided in the support portion to connect the liquid supply flow channel to the outside of the support portion without going through the discharge portion, wherein the cap is able to cover, from the first direction side, an expeller outlet being an end portion on the first direction side of the expeller portion, and at least one of the first cover portion and the second cover portion has an opening that exposes the expeller outlet to the first direction side.

7. The print device according to claim 6, further comprising:

a platen having a holding face capable of holding the print medium such that the print medium faces the discharge face, the holding face being provided to hold the print medium to the first direction side of the support portion, wherein the expeller outlet is located to the fourth direction side of the discharge portion, and the opening is provided in the second flat face part of the second cover portion.

8. The print device according to claim 1, wherein each of the first flat face part and the second flat face part is provided at a position where the each of the first flat face part and the second flat face part is in contact with an upper edge of the wiper when the wiper moves from the third direction side to the fourth direction side while in contact with the discharge face from the first direction side.

9. The print device according to claim 1, wherein each of the first cover portion and the second cover portion is fixed on the support portion.

10. The print device according to claim 1, wherein the first flat face part has a length in an orthogonal direction being larger than the length of the second flat face part in the orthogonal direction, the orthogonal direction being orthogonal to the third direction and the fourth direction, the orthogonal direction being parallel to the discharge face.

* * * * *